US006141877A

United States Patent [19]

Suetsugu

[11] Patent Number: 6,141,877

[45] Date of Patent: Nov. 7, 2000

[54] NOTCHED SINGLE-EDGED THINNING SCISSORS

[75] Inventor: Noriyoshi Suetsugu, Kakamigahara, Japan

[73] Assignee: Hamonoya Toginon Inc., Japan

[21] Appl. No.: 09/328,445

[22] Filed: Jun. 9, 1999

[30] Foreign Application Priority Data

Jun. 29, 1998 [JP] Japan ..... 10-182274

[51] Int. Cl.[7] ..... B26B 13/06

[52] U.S. Cl. ..... 30/195; 30/233.5

[58] Field of Search ..... 30/195, 233.5, 30/225, 254, 258, 256, 355

[56] References Cited

U.S. PATENT DOCUMENTS

| | | | |
|---|---|---|---|
| 1,430,512 | 9/1922 | Langlais | 30/233.5 |
| 2,267,949 | 12/1941 | Reed | 30/195 |
| 2,558,264 | 6/1951 | Metcalf | 30/195 |
| 2,591,014 | 4/1952 | Sansom | 30/195 |
| 2,758,371 | 8/1956 | Machesani | 30/195 |
| 3,257,723 | 6/1966 | Cercone | 30/195 |
| 4,660,285 | 4/1987 | Pracht | 30/195 |
| 5,107,591 | 4/1992 | Sato | 30/195 |
| 5,875,553 | 3/1999 | Geib, Jr. et al. | 30/195 |

FOREIGN PATENT DOCUMENTS

| | | | |
|---|---|---|---|
| 809045 | 7/1951 | Germany | 30/195 |
| 932476 | 8/1955 | Germany | 30/195 |
| 39687 | 1/1969 | Germany | 30/195 |
| DT 4000927 | 1/1991 | Germany | 30/195 |

*Primary Examiner*—Rinaldi I. Rada
*Assistant Examiner*—Omar Flores-Sánchez
*Attorney, Agent, or Firm*—Liniak, Berenato, Longacre & White, LLC

[57] ABSTRACT

There are described notched single-edged thinning scissors which are easy to use, can be moved without damaging hairs remaining in spaces that are formed by closing the scissors, and can be readily removed from the hair. The notched single-edged thinning scissors includes a first piece having a plurality of teeth and a second piece which is attached to the first piece so as to be pivotable about a pivot and which forms spaces in clearances between the teeth when the first and second pieces are closed. Semi-circular notches are formed at uniform intervals along a lower portion of the second piece with reference to the pivot. A plurality of teeth spaced apart from each other are formed in a lower portion of the second piece with reference to the pivot. When the scissors are moved after the first and second pieces have been closed to cut the hair, the hair remaining in the clearances among the teeth are detached from the scissors without being damaged.

5 Claims, 6 Drawing Sheets

NOTCHED SINGLE-EDGED THINNING SCISSORS

BACKGROUND OF THE INVENTION

1. Field of the Invention

The present invention relates to a notched single-edged thinning scissors, and more particularly, to a notched single-edged thinning scissors for use in thinning hair.

2. Description of the Related Art

In barber shops and beauty parlors, scissors have conventionally been used in cutting hair according to the customer's instruction. Depending on the customer's hair style, the hairdresser uses notched single-edge thinning scissors to adjust the volume as well as the length of hair.

As shown in FIG. 5, a conventional pair of notched single-edged thinning scissors 30 (hereinafter simply referred to as "scissors 30") comprises a blade 31 and a notched edge 33 which is supported on the blade 31 so as to pivotally move about a pivot 32. Each of the blade 31 and the notched edge 33 has a shank 35 having a ring handle 34. A cutting edge 36 is formed along the edge of the blade 31 facing the notched edge 33. Teeth 37 are formed so as to be spaced apart from one another along the side of the notched edge 33 facing the blade 31. A groove 38 is formed in the tip end of each of the teeth 37.

When hair is thinned through use of the scissors 30, hair is pinched between the blade 31 and the notched edge 33. As shown in FIG. 6, if the blade 31 and the notched edge 33 are closed in this state, the blade 31 and the teeth 37 overlap each other. A clearance 39 between adjacent teeth 37 is closed by the blade 31, thus creating a space 40. Hairs caught by the grooves 38 of the teeth 37 are cut by the cutting edge 36 of the blade 31. Hairs which are located so as not to overlap with the teeth 37 (i.e., hairs which fall within the clearances 39) are left uncut in the spaces 40.

As shown in FIG. 6, the space 40 is formed by means of a closing action of the cutting edge 36 of the blade 31. If the scissors 30 are moved while the hairs remain in the space 40, the hairs and the cutting edge 36 rub against one another. At this time, the cutting edge 36 engages with or becomes caught in the hairs, with the result that the surface of hairs may be damaged. Further, the thus-damaged hairs may give rise to split ends.

In order to remove the scissors 30 from the hair after cutting the hair through use of the same while the scissors 30 are closed, the hairdresser must handle the scissors 30 carefully so as to avoid damaging the hair. If the hairdresser is not accustomed to handling the scissors 30, learning the use of the scissors 30 takes some time.

SUMMARY OF THE INVENTION

Accordingly, the object of the present invention is to provide a notched single-edged thinning scissors which are easy to use, can be moved without damaging hairs remaining in the space formed in the scissors when the scissors are closed, and can be readily removed from the hair.

To achieve the object, according to one aspect of the present invention, there are provided notched single-edged thinning scissors including a first piece having a plurality of teeth and a second piece which is attached to the first piece so as to be pivotable about a pivot and which constitutes spaces in clearances between the teeth when the first and second pieces are closed, wherein a cutting edge is formed solely on the tip end of each of the teeth of the first piece, and no cutting edge is formed along the second piece.

In order to reduce the volume of hair to be thinned, the first and second pieces of the scissors are opened so as to catch the hair between them. As the first and second pieces are gradually brought together (closed) in this state, the teeth gradually come into an overlapping engagement with the second piece. A clearance between the teeth is closed by the second piece to thereby constitute a space therein, and the space becomes gradually smaller. At this time, as a result of the teeth overlapping with the second piece, the hairs remaining in contact with the second piece are cut by a cutting edge provided at the tip end of each of the teeth. The hair present in the spaces still remains, exactly as it is. When the first and second pieces are fully closed, the teeth overlap with the respective notches, and the hair present in the spaces between the teeth remains uncut.

If the scissors are moved in this state, the hair remaining in the spaces are rubbed against the outside edges defining the spaces. However, no cutting edge is formed along the second piece that closes the spaces, and hence no cutting edge exists on the outside edges defining the spaces. Therefore, even if the scissors are moved, the hairs remaining in the spaces can be removed from the scissors without being damaged by the outside edges defining the spaces.

Preferably, notches are formed in the second piece at such positions as to come into contact with the respective tip ends of the teeth when the first and second pieces are closed.

When hair is thinned by means of the scissors, the hairs in contact with the second piece enter the notches formed in the second piece to a predetermined depth. In other words, the hairs caught by the notches are retained in the notches and cannot move away from the notches. If the first and second pieces are gradually closed, the hairs caught by the notches do not fall out of the teeth but are cut by the cutting edges of the teeth without fail. Further, the number of hairs cut by a single tooth can be changed by changing the size of the notches.

Preferably, the notches overlap with the teeth when the first and second pieces are closed.

As a result, when the first and second pieces are fully closed until the second piece overlaps with all the teeth, the notches overlap with the second piece. In this state, even when the hairs are present in the spaces, the notches do not communicate with the spaces between the teeth. Hence, the hairs present in the spaces are prevented from entering the notches.

Preferably, the teeth overlap with the respective notches in substantially their center positions from the time the tip ends of the teeth come into contact with the notches until the first and second pieces are fully closed.

In the scissors according to the present invention, the teeth and the notches constantly remain in contact with or overlap one another from the time the teeth come into contact with the second piece until the first and second pieces are fully closed. As a result, the notches do not communicate with the spaces between the teeth, and hence the hair present in the spaces are prevented from entering the spaces. Consequently, even when the scissors are moved during the period from establishment of a state in which the teeth are in contact with the second piece to the time the first and second pieces are fully closed, the hairs present in the spaces are not nipped by the notches, thereby preventing damage to the hair, which would otherwise be caused when the hair is rubbed against the outside edges defining the spaces.

Preferably, the teeth are formed into a circular-arc shape so as to follow circular paths which center on the pivot and pass through the respective notches.

As a result, the teeth and the notches constantly maintain contact with or overlap with one another from the time when the teeth come into contact with the second piece until the first and second pieces are fully closed, thereby yielding the same advantageous result as described above. Further, the teeth are formed so as to follow circular paths centered on the pivot, thus constituting spaces which are substantially equal in width from their base ends to their tip ends.

DETAILED DESCRIPTION OF THE PREFERRED EMBODIMENT

A preferred embodiment of the present invention will be described hereinbelow by reference to FIGS. 1 through 4.

Figure 1:
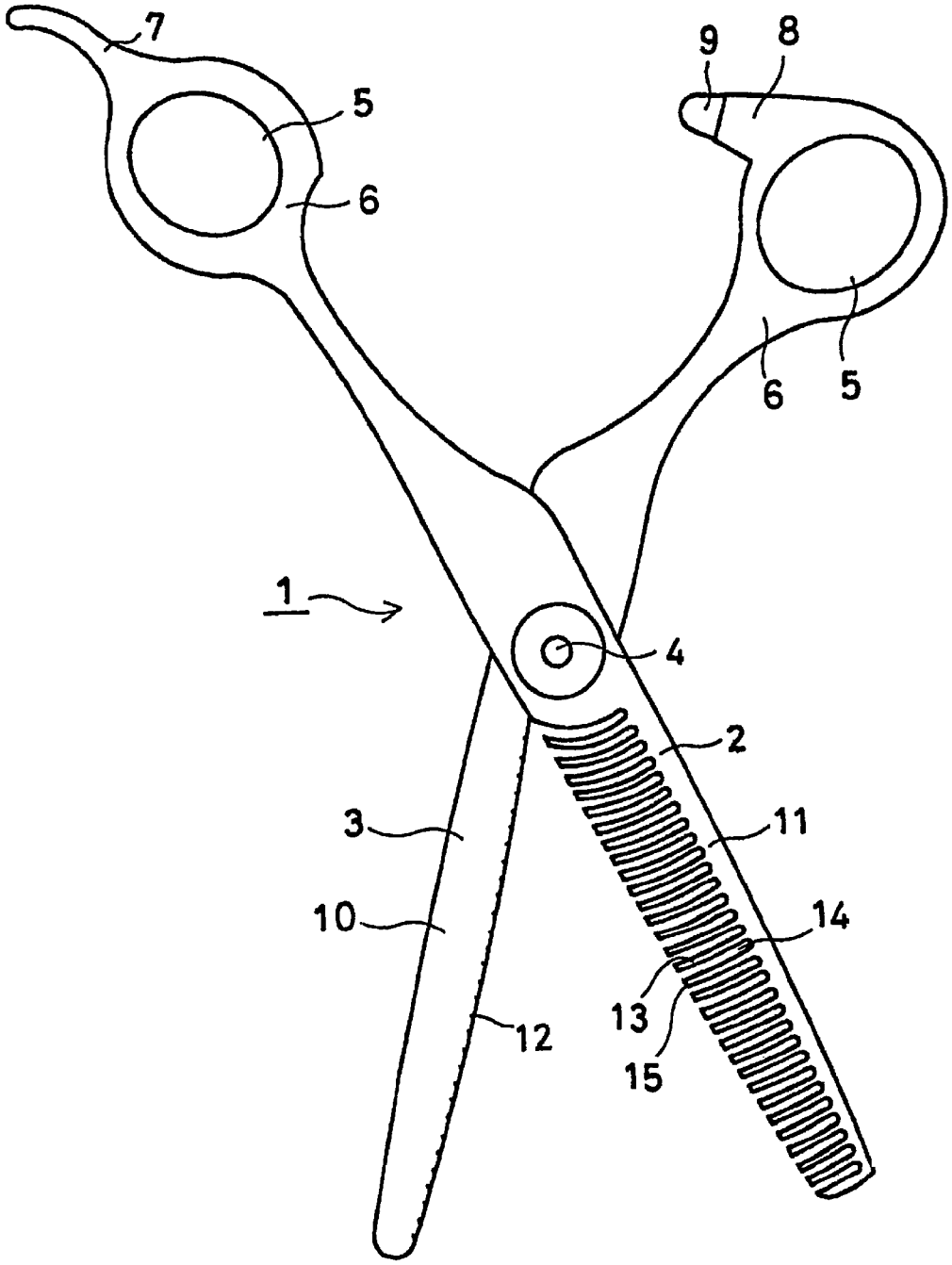
FIG. 1 is a front view showing the notched single-edged thinning scissors according to one embodiment of the present invention.
Figure 2:
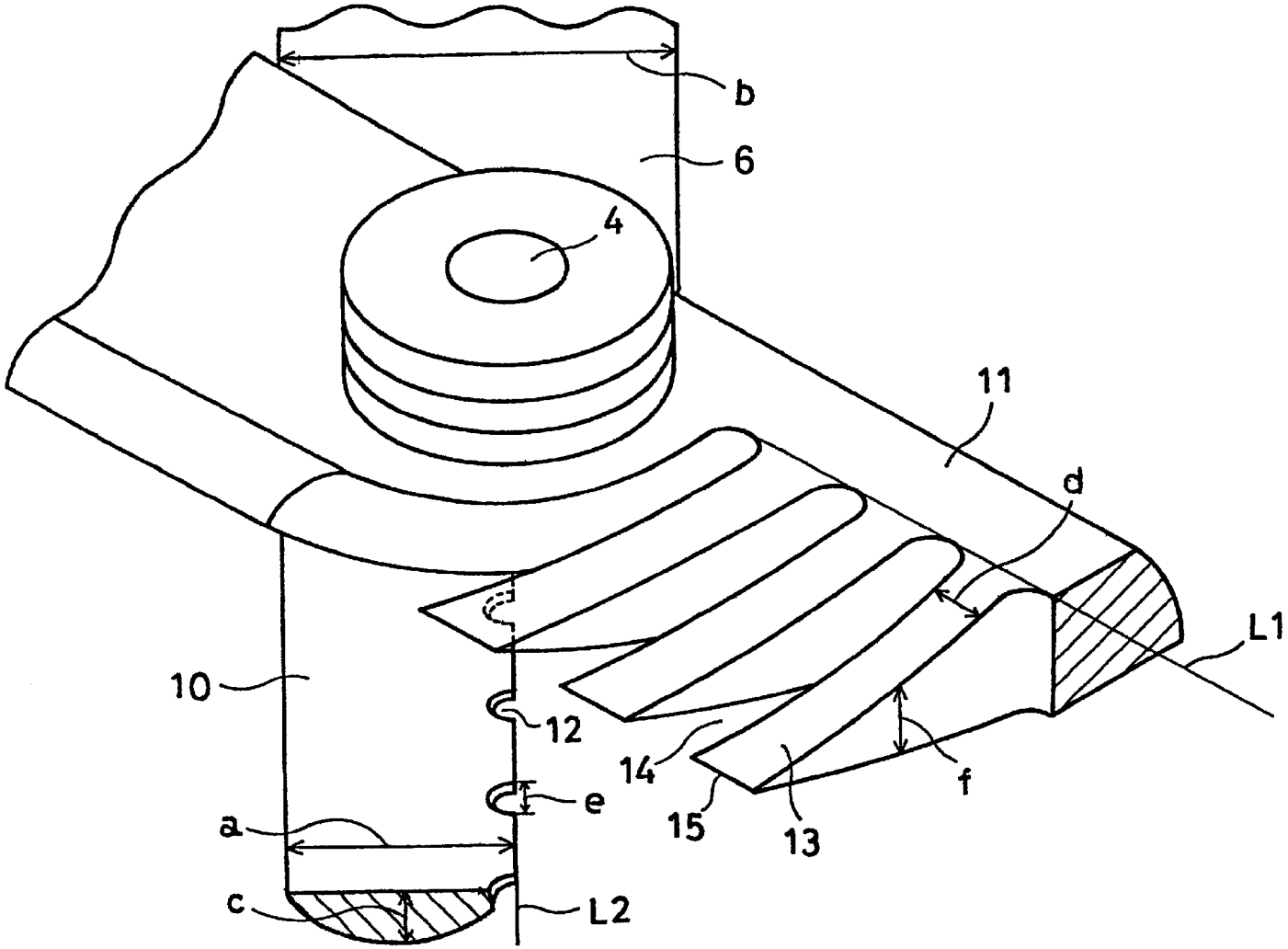
FIG. 2 is an enlarged perspective view showing the vicinity of a pivot of the notched single-edged thinning scissors shown in FIG. 1.
Figure 3:
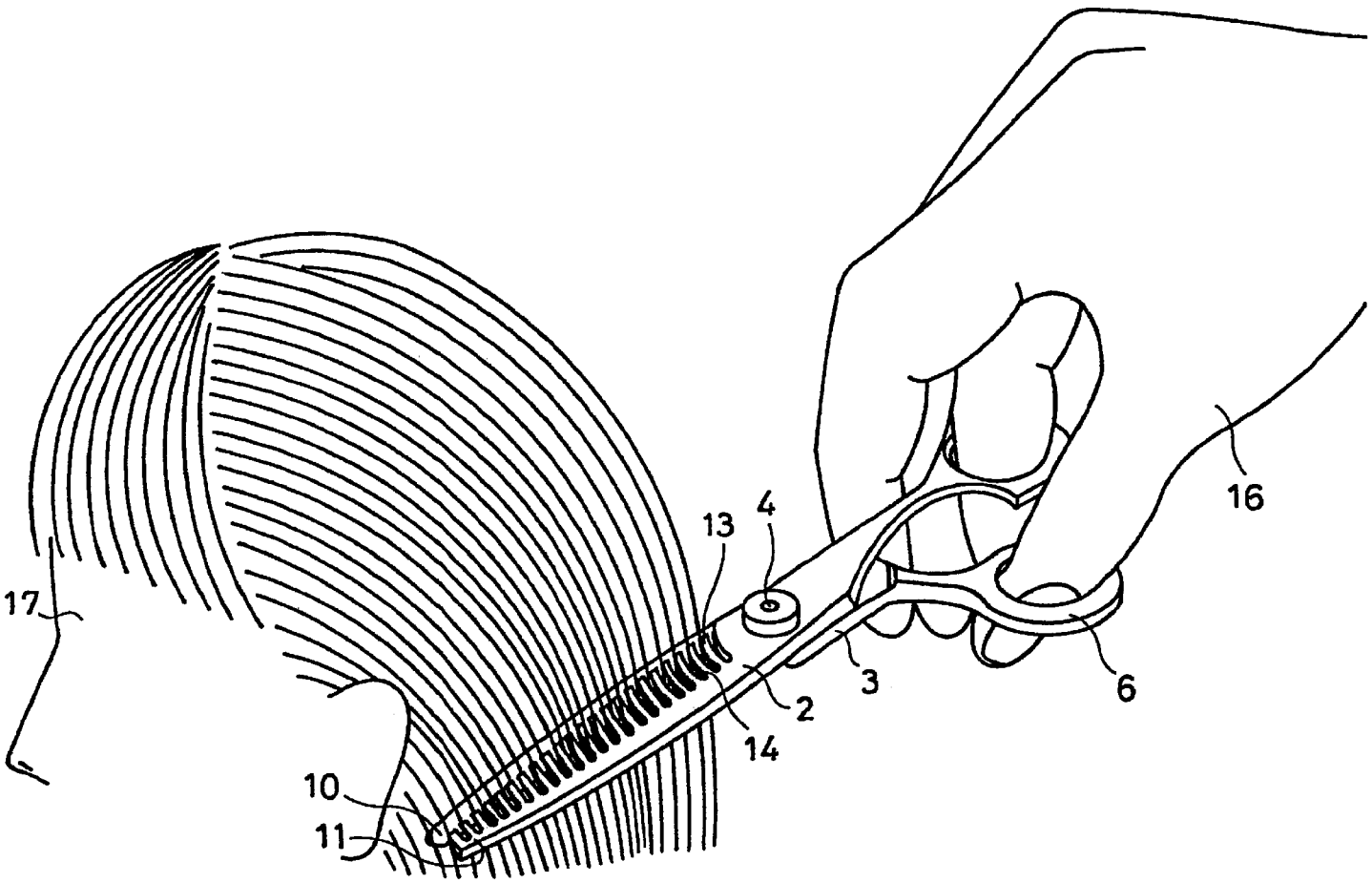
FIG. 3 is a perspective view showing the notched single-edged thinning scissors shown in FIG. 1 when the scissors are in use.
Figure 4:
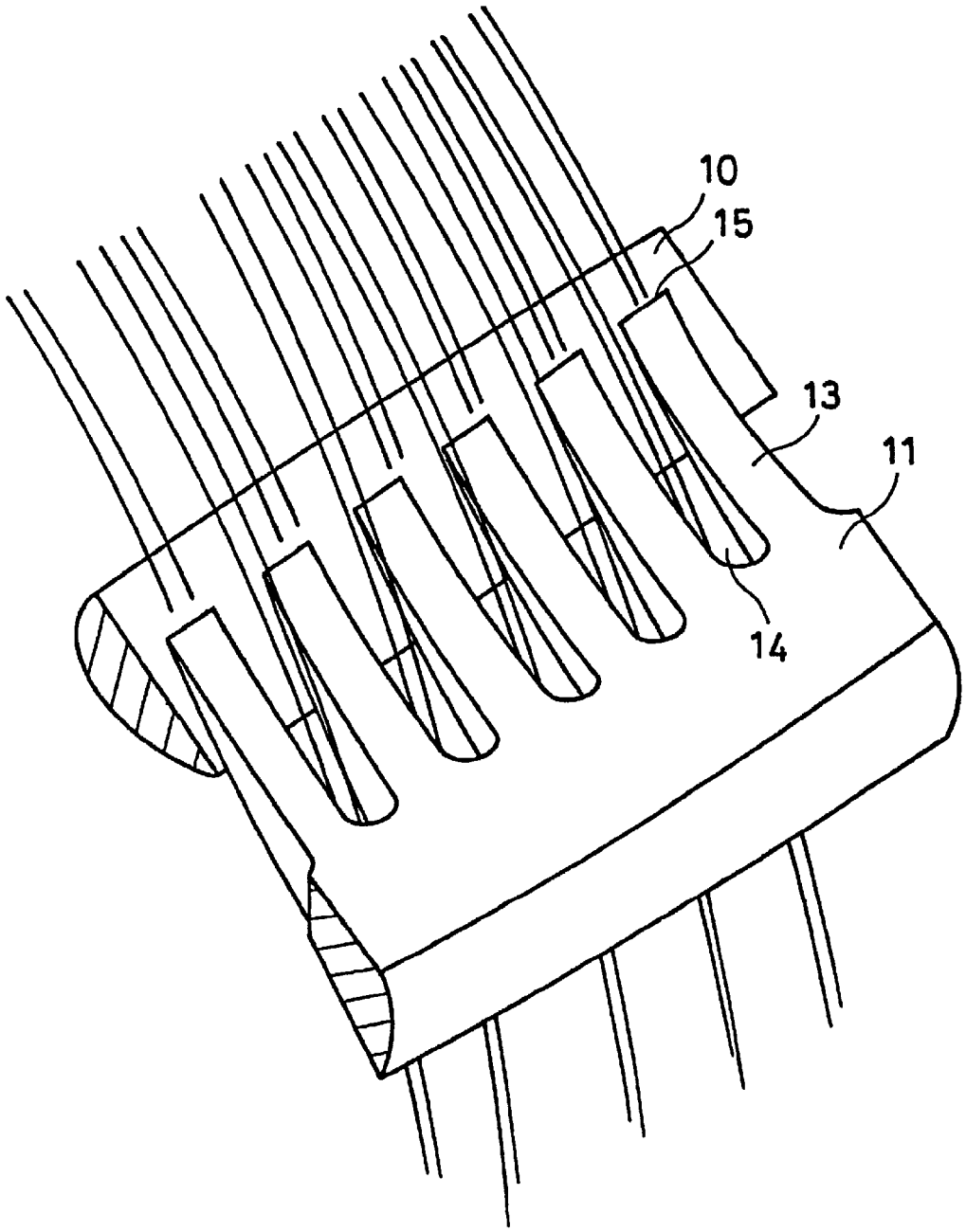
FIG. 4 is an enlarged perspective view showing the principal elements of the scissors shown in FIG. 3.
Figure 5:
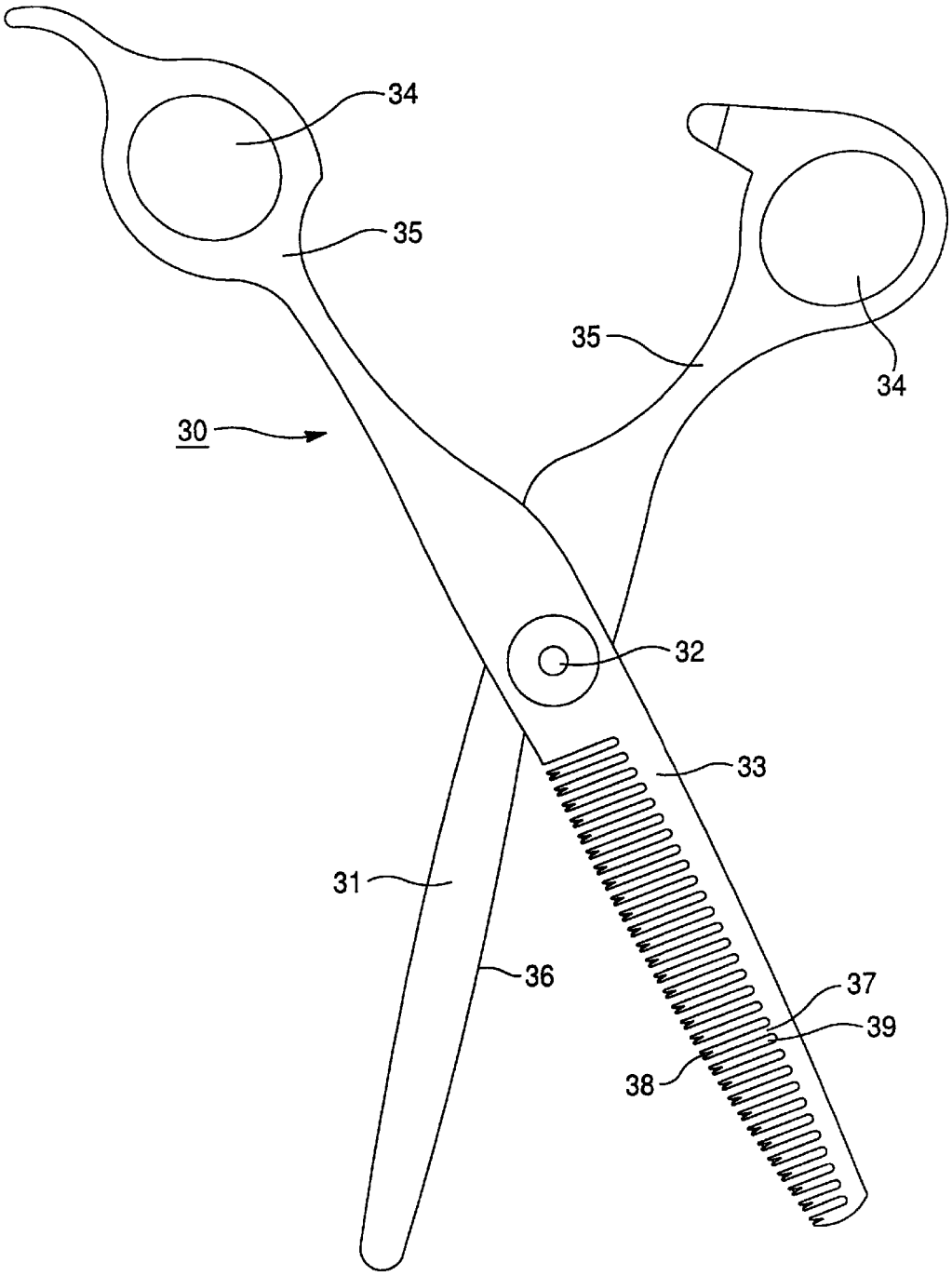
Fig. 5 Prior Art
FIG. 5 is a front view showing conventional notched single-edged thinning scissors.
Figure 6:
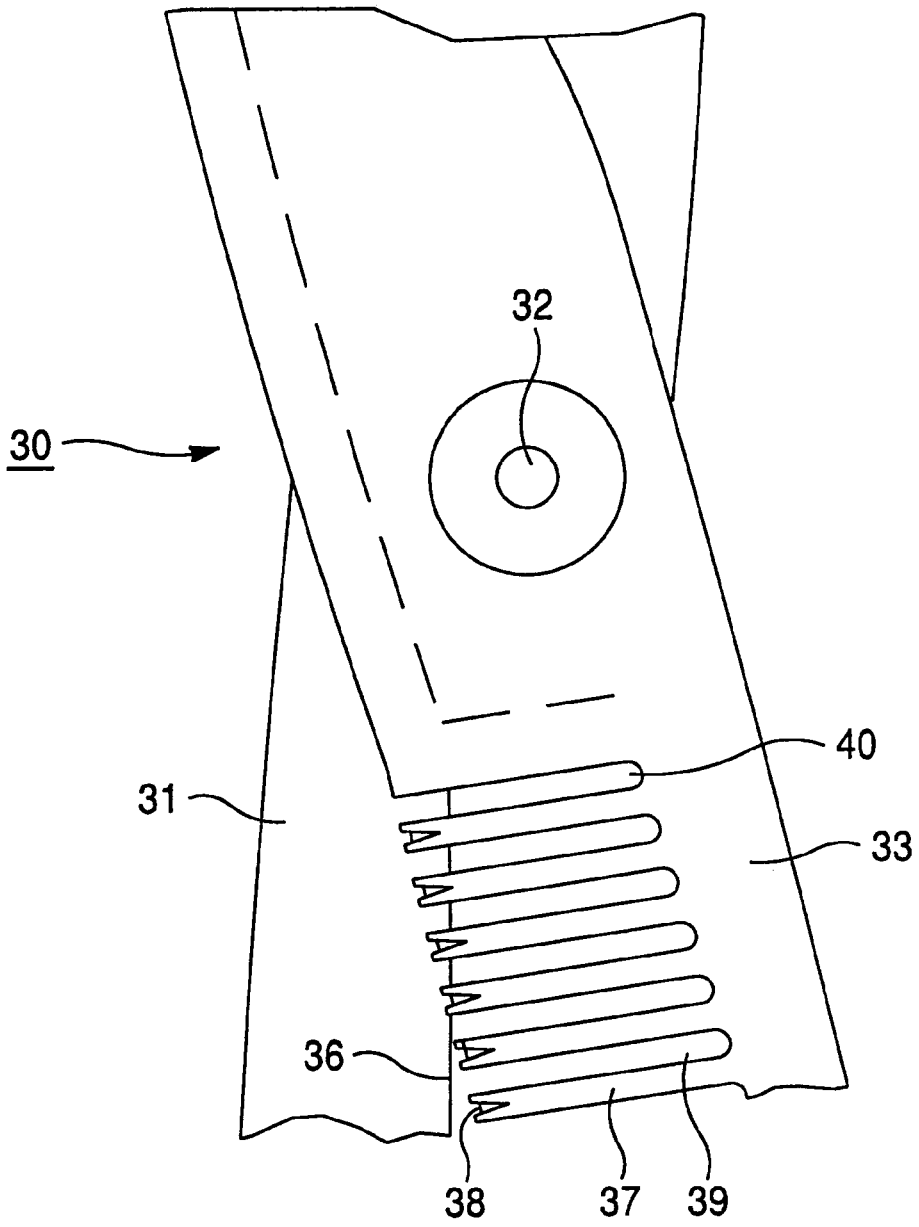
Fig. 6 Prior Art
FIG. 6 is an enlarged view showing the vicinity of a pivot of the conventional scissors.

FIG. 1 is a front view showing notched single-edged thinning scissors according to one embodiment of the present invention; FIG. 2 is an enlarged perspective view showing the vicinity of a pivot of the notched single-edged thinning scissors shown in FIG. 1; FIG. 3 is a perspective view showing the notched single-edged thinning scissors shown in FIG. 1 when the scissors are in use; and FIG. 4 is an enlarged perspective view showing the principal elements of the scissors shown in FIG. 3. Throughout the specification, the expressions "upward," "downward," "right-side," "left-side," and like expressions are used herein to designate parts of the notched single-edge thinning scissors according to the present invention when the scissors are oriented such that the handle portions of the scissors are located in an elevated position and the blade portions of the same are located in a lower position relative to the handle portions as shown in, for example, FIG. 1.

As shown in FIG. 1, the notched single-edged thinning scissors 1 (hereinafter referred to simply as "scissors 1") according to an embodiment of the present invention comprise a first scissors piece (hereinafter simply referred to as a "first piece") 2 and a second scissors piece (hereinafter simply referred to as a "second piece") 3. The first piece 2 is attached to the second piece 3 so as to pivotally move about a pivot 4. The surface of the first piece 2 and the surface of the second piece 3, which are in contact with each other, are substantially smooth. No clearance arises between the first piece 2 and the second piece 3 when the first and second pieces 2 and 3 are actuated so as to open and close.

The upper portion of the first piece 2 relative to the pivot 4 is formed into a shank 6 having a ring handle 5, and the upper portion of the second piece 3 relative to the pivot 4 is also formed into the shank 6 having the ring handle 5. When the user uses the scissors 1, the thumb and the third finger are inserted into the respective ring handles 5. A finger rest 7 for receiving the fifth finger when the user uses the scissors 1 is provided in the vicinity of the ring handle 5 of the first piece 2. A blade close stop 8 and a stop cushion 9, which together act as a stopper when the first and second pieces 2 and 3 are fully closed, are provided in the vicinity of the ring handle 5 of the second piece 3.

The lower portion of the second piece 2 relative to the pivot 4 is thinly formed into a second blade 10 having width "a." The width "a" of the second blade 10 is about half the width "b" of the shank 6. The second blade 10 is slightly longer than the lower portion of the first piece 2 relative to the pivot 4; i.e., a first notched edge 11. The thickness "c" of the second blade 10 is gradually diminished in a transverse direction toward the first notched edge 11. Instead of a single blade, a plurality of small notches 12 of semicircular shape are formed at uniform intervals along the edge of the second blade 10 facing the first notched edge 11.

The first notched edge 11 becomes more narrow in width in a lengthwise and downward direction. A plurality of teeth 13 are formed so as to be spaced apart from one another along the side of the first notched edge 11 facing the second blade 10. The teeth 13 and the notches 12 are identical in number and are uniformly spaced apart from one another in a lengthwise direction at constant intervals. A clearance 14 is formed between the teeth 13.

As shown in FIG. 2, the tooth 13 has a uniform width "d" over its entire length from its base end to tip end. The width "d" is greater than the diameter "e" of the notch 12. The thickness "f" of the teeth 13 is increasingly diminished toward the second blade 10 in the manner of a talon of a bird. A sharp cutting edge 15 is formed at the tip end of each of the teeth 13. The teeth 13 are formed into a circular-arc shape so as to follow circular paths centered on the pivot 4 and pass through the respective notches 12. In a state in which the teeth 13 remain in contact with and overlap the second blade 10, regardless of the angle of intersection between the first piece 2 and the second piece 3, the notches 12 do not extend at all beyond the corresponding teeth 13 but overlap with each other precisely. The length of the tooth 13 is set so as to be about two-thirds the overall width of the first notched edge 11 including the teeth 13.

The scissors 1 have the clearances 14 which do not overlap with the second blade 10 when the first piece 2 and the second piece 3 are fully closed. The teeth 13 are formed such that a tangential line L1 in contact with the individual teeth 13 runs through the right-side region with reference to a longitudinal axis passing through the center of the pivot 4. Further, the second blade 10 is formed such that a tangential line L2 facing the first notched edge 11 runs through the center of the pivot 4 or in the left-side region relative to the longitudinal axis passing through the center of the pivot 4. The blade close stop 8 and the stop cushion 9 are provided such that when the first piece 2 and the second piece 3 are fully closed the tangential line L1 becomes almost parallel with the tangential line L2. Consequently, when the first piece 2 and the second piece 3 are fully closed, the respective clearances 14 do not overlap the second blade 10, and the respective clearances 14 become substantially equal with one another in terms of the size of the regions where the clearances 14 do not overlap the second blade 10. In short, as a result of the first notched edge 11 overlapping with the second blade 10, the clearances 14 constitute a plurality of spaces of substantially the same size.

The operation of the scissors 1 according to the present invention having the foregoing structure and an advantageous result yielded thereby will now be described.

As shown in FIG. 3, in a case where the hairs are thinned through use of the scissors 1 according to the present embodiment, a right-handed user holds the scissors 1 with his right hand 16, and the first piece 2 and the second piece 3 are opened while the second blade 10 is faced toward the head of a customer 17. The hair is inserted into the space between the first notched edge 11 and the second blade 10. At this time, the thus-nipped hair also enters the notches 12.

As show in FIG. 2, when The first piece 2 and the second piece 3 are gradually closed together from this state, the teeth 13 come to overlap with the second blade 10 in sequence from the tooth 13 closest to the pivot 4. The hairs caught in the notches 12 come into contact with the second blade 10 and are cut by the cutting edge 15 provided at the tip end of each of the teeth 13. The hairs caught by the notches 12 cannot move and are cut without fail. At the same time, the hairs caught in the clearances 14 between the teeth 13 of the first blade 11 remain intact. The clearances 14 are closed by the second blade 10, thereby constituting closed spaces.

When the first piece 2 and the second piece 3 are closed together further from this state, the teeth 13 gradually come into_an overlapping engagement with the second blade 10 in sequence from the tooth 13 closest to the pivot 4. The teeth 13 that overlap the second blade 10 constantly remain in an overlapping engagement with the notches 12. Consequently, the hair caught in the clearances 14 are prevented from entering the notches 12 until the first piece 2 and the second piece 3 are opened and the teeth 13 depart from the second blade 10.

As shown in FIG. 3, when the shank 6 of the first piece 2 comes into contact with the stop cushion 9, the tooth 13 located at the most distant position from the pivot 4 overlaps the second blade 10, thereby cutting the hairs caught by the notch 12. FIG. 4 is an enlarged perspective view showing the principal portions of the scissors 1 shown in FIG. 3. As shown in FIG. 4, the hairs that are not cut remain in the clearances 14.

When the scissors 1 are moved in this state, the hairs remaining intact are rubbed against the outside edges defining the clearances 14 and the second notched edge 11. However, at this time nothing which would damage the hair exists at the outside edges defining the clearances 14. No cutting edge is formed along the second blade 10, therefore preventing damage to the hairs, which would otherwise be caused by the conventional notched single-edged thinning scissors. Further, the notches 12 are located at the positions where the teeth 13 overlap the second blade 10, thereby preventing the hair remaining in the clearances 14 from being nipped by the notches 12. Therefore, there is prevented damage to the hairs remaining in the clearances 14, which would otherwise be caused when the hairs are rubbed against the second blade 10 and the outside edges defining the clearances 14. Accordingly, the scissors 1 can be moved smoothly as in the case of combing, so that the hairs remaining in the clearances 14 can be readily removed from the clearances 14.

As mentioned above, the scissors 1 according to the present embodiment comprise the first piece 2 having the plurality of teeth 13 and the second piece 3 which is attached to the first piece 2 so as to be pivotally moved about the pivot 4. Further, the second piece 3 constitutes spaces between the teeth 13 and the respective clearances 14 so that hairs can remain in the spaces when the first and second pieces 2 and 3 are closed. Further, the cutting edge 15 is formed solely at the tip end of each of the teeth 13 of the first piece 2, and no cutting edge is formed along the second piece 3.

So long as the scissors 1 according to the present embodiment are utilized, worrying about damage to hair becomes unnecessary even when the scissors 1 are moved while the first and second pieces 2 and 3 are closed. Therefore, the user can quickly cut hair even by repeatedly cutting hair through use of the scissors 1. Further, even a user who is not familiar with the operation of the scissors 1 can use the scissors 1 very easily.

Particularly, the notches 12 are formed in the portions of the second piece 3 that come into contact with the respective tip ends of the teeth 13 when the first and second pieces 2 and 3 are closed. Consequently, when the hairs are diminished in volume by cutting hair through use of the scissors 1, the hairs that come into contact with the second piece 3 enter the notches 12 of the second pieces 3 to a predetermined depth, with the result that the hairs caught by the notches 12 are cut by the cutting edge 15 provided on the respective teeth 13 without fail.

Further, when the first and second pieces 2 and 3 are closed, the notches 12 overlap the teeth 13. Even if hairs are present in the spaces constituted by the clearances 14 and the second blade 10, the notches 12 are prevented from communicating with the spaces. Therefore, the hairs present in the spaces are prevented from entering the notches 12. Even if the scissors 1 are moved, the hairs present in the spaces are prevented from being caught by the notches 12 and are prevented from being damaged through rubbing.

The teeth 13 are formed into a circular-arc shape so as to follow circular paths which center on the pivot 4 and pass through the respective notches 12. The teeth 13 overlap the notches 12 at substantially the center positions thereof, from the time the tip ends of the teeth 13 start coming into contact with the notches 12 and until the first and second pieces 2 and 3 are fully closed. Consequently, even if the scissors 1 are moved before the first and second pieces 2 and 3 are fully closed after coming into contact with each other, the hairs present in the spaces are not nipped by the notches 12, thereby preventing damage to the hair, which would otherwise be caused when the hairs are rubbed against the outside edges defining the spaces.

The notches 12 and the teeth 13 may be changed in any desired manner in terms of shape, interval, number, and width. Further, the depth and shape of the notches 12 may also be changed according to the volume of hair to be thinned. For example, if the respective notches 12 are large, the number of hairs cut by the notch is increased. Conversely, if the respective notches 12 are small, the number of hairs cut by the notch is reduced. Thus, the shape and size of the notches 12 can be changed according to an objective of use of the scissors.

The size and shape of the notches 12 may be changed according to the distance from the pivot 4. Further, the width "d" and shape of the teeth 13 may also be changed in the same manner.

The scissors 1 according to the embodiment of the present invention are for use by a right-handed person. However, the scissors 1 may be modified for use by a left-handed person. Further, in order to cut hair into toothed hair, the second blade 10 may be formed along the first piece 2, and the first notched edge 11 may be formed along the second piece 3. In short, the teeth 13 may be formed in another piece of the scissors 1.

As has been mentioned above, in the notched single-edged thinning scissors according to the present invention, moving the scissors and removal of the scissors from hair can be effected without damaging hair while the first and second pieces are closed together. Further, even a user who is not familiar with the handling of a notched single-edged thinning scissors can easily use the scissors.

Further, the hairs caught by the notches formed in the second piece can be cut by the blade without fail. Further, the number of hairs to be cut by a single tooth can be controlled by means of the size of the notch.

Even if the scissors are moved while the first and second pieces are closed, the hair remaining in the spaces are prevented from being nipped by the notches, thereby preventing damage to the hair, which would otherwise be caused when the hairs are rubbed against the outside edges defining the spaces.

The hairs remaining in the spaces are prevented from being nipped by the notches from the time the teeth come into contact with the second piece until the first and second pieces are fully closed, thereby preventing damage to the hair, which would otherwise be caused when the hairs are rubbed against the outside edges defining the spaces.

Since the teeth are uniform in width from their root ends to their tip ends, the hair encounters little resistance from the outside edges defining the spaces when the scissors are moved.

What is claimed is:

1. Notched single-edged thinning scissors including a first piece having a plurality of teeth and a second piece which is attached to the first piece so as to be pivotable about a pivot, said first and second pieces defining discrete spaces sized to receive hair between the teeth when the first and second pieces are in an overlapping closed position, wherein a hair cutting edge is formed on a tip end of each of the teeth of the first piece, said cutting edge cutting hair when it interfaces with the second piece, wherein a blunt, non-cutting edge is formed on the second piece facing said spaces sized to receive hair, said non-cutting edge is formed to contact said hair in the closed position without initiating a cutting effect upon said hair.

2. The notched single-edged thinning scissors as defined in claim 1, further comprising a plurality of notches formed in the second piece at such positions as to be aligned with and come into contact with the respective tip ends of the teeth as the first and second pieces are closed.

3. The notched single-edged thinning scissors as defined in claim 2, wherein the notches overlap the teeth when the first and second pieces are closed.

4. The notched single-edged thinning scissors as defined in claim 2, wherein the teeth overlap with the respective notches in substantially their center positions from the time the tip ends of the teeth come into contact with the notches until the first and second pieces are fully closed.

5. The notched single-edged thinning scissors as defined in claim 4, wherein the teeth are formed into a circular-arc shape so as to follow circular paths which center on the pivot and pass through the respective notches.

* * * * *